US005488211A

United States Patent [19]

Castonguay et al.

[11] Patent Number: 5,488,211

[45] Date of Patent: Jan. 30, 1996

[54] LATCHING ARRANGEMENT FOR HIGH AMPERE-RATED CIRCUIT BREAKER OPERATING SPRINGS

[76] Inventors: Roger N. Castonguay, 5 Ellen Dr., Terryville, Conn. 06786; James L. Rosen, 478 Fern St., West Hartford, Conn. 06107; Mark A. Zaffetti, 10 Town Line Rd., Windsor Locks, Conn. 06096

[21] Appl. No.: 218,287

[22] Filed: Mar. 28, 1994

[51] Int. Cl.[6] ..... H01H 3/30

[52] U.S. Cl. ..... 200/400

[58] Field of Search ..... 200/400

[56] References Cited

U.S. PATENT DOCUMENTS

| | | | |
|---|---|---|---|
| 2,581,181 | 1/1952 | Fevre . | |
| 3,301,984 | 1/1967 | Wilson | 200/400 |
| 3,845,263 | 10/1974 | Dickinson | 200/400 |
| 4,001,742 | 1/1977 | Jencks et al. . | |
| 4,801,907 | 1/1989 | Kelaita et al. . | |
| 5,140,117 | 8/1992 | Vianson | 200/400 |

OTHER PUBLICATIONS

Castonguay et al. "Operating Mechanism for High Ampere–Rated Circuit Breakers" U.S. Ser. No. 08/202,140 Filed Feb. 25, 1994.

Castonguay et al "Rating Module Unit for High Ampere–Rated Circuit Breaker" U.S. Ser. No. 08/203,062 filed Feb. 28, 1994.

Castonguay et al "Handle Operator Assembly for High Ampere–rated Circuit Breaker" U.S. Ser. No. 08/214,522, filed Mar. 18, 1994.

*Primary Examiner*—Renee S. Luebke

[57] ABSTRACT

This invention relates to a high ampere-rated circuit breaker which meets the electrical code requirements of the world market. The charging of the powerful operating springs controlling the circuit breaker contacts is made manually by means of a ratchet and pawl assembly. A two stage latching arrangement controls the retention and release of the pawl to retain and discharge the operating springs.

14 Claims, 4 Drawing Sheets

LATCHING ARRANGEMENT FOR HIGH AMPERE-RATED CIRCUIT BREAKER OPERATING SPRINGS

BACKGROUND OF THE INVENTION

U.S. Pat. No. 4,001,742 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts.

U.S. Patent Application entitled "Operating mechanism for high ampere-rated circuit breaker" Ser. No. 08/202,140, filed Feb. 25, 1994, describes an operating mechanism capable of immediately resetting the circuit breaker operating mechanism to reclose the contacts without having to recharge the circuit breaker operating springs immediately after opening the circuit breaker contacts.

U.S. Patent Application entitled "Rating module unit for high ampere-rated circuit breaker" Ser. No. 08/203,062 filed Feb. 28, 1994, describes a circuit breaker closing spring modular unit whereby the circuit breaker operating springs are contained within a separate unit from the operating mechanism and can be installed within the circuit breaker enclosure without disturbing the operating mechanism assembly.

U.S. Patent Application entitled "Handle operator assembly for high ampere-rated circuit breaker" Ser. No. 08/214,522 filed Mar. 18, 1994, describes a handle operator unit capable of generating large spring charging forces by means of an externally-accessible manually operated handle. A ratchet and pawl assembly allows the manually-applied charging forces to be applied to the operating springs. Once the circuit breaker operating mechanism closing springs are fully-charged, some means must be employed to release the pawl to allow the closing springs to become fully operational.

Accordingly, one purpose of this invention is to describe a simple and efficient latching arrangement that controls the retention and release of the pawl to insure that the operating springs are fully operational at all times.

SUMMARY OF THE INVENTION

The circuit breaker operating mechanism operating springs are charged by means of an externally accessible handle that includes a handle drive gear and pawl assembly. A two stage latching arrangement is employed to insure that the operating springs are first brought to their fully charged condition and then allowed to operate free from the pawl assembly.

DESCRIPTION OF THE PREFERRED EMBODIMENT

Figure 1:
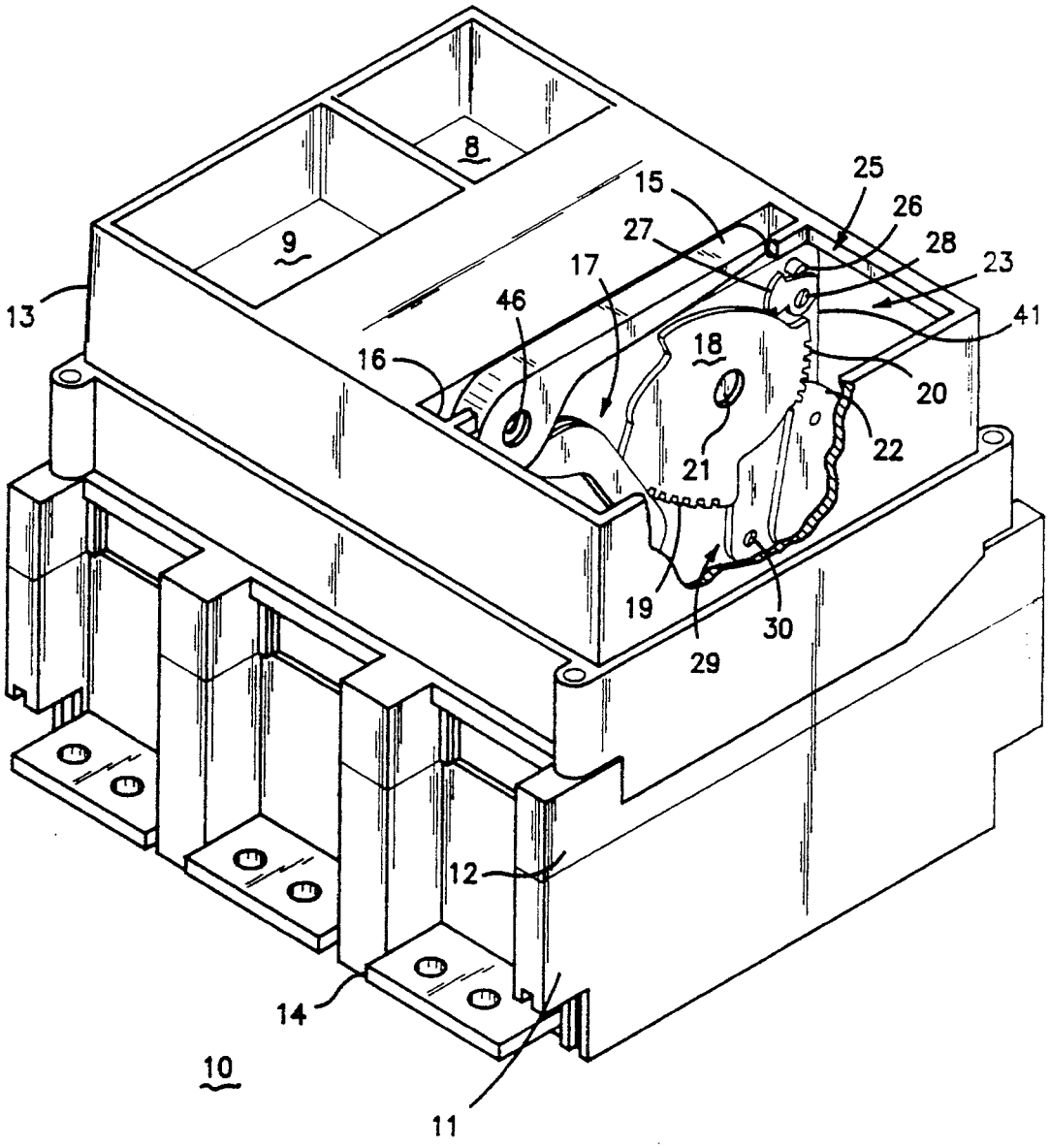
FIG. 1 is a top perspective view of a high ampere-rated circuit breaker with a portion of the circuit breaker cover removed to depict the operating springs latching assembly according to the invention.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 12 of similar insulative material is attached prior to attaching the top cover 13, also consisting of an electrically-insulative material. Electrical connection with the interior current-carrying components is made by load terminal straps 14 extending from one side of the base and line terminal straps (not shown) extending from the opposite side thereof. The interior components are controlled by an electronic trip unit contained within a recess 8 on the top surface of the top cover 13. Although not shown herein, the trip unit is similar to that described within U.S. Pat. No. 2,581,181 and interacts further with an accessory contained within the accessory recess 9 to provide a range of protection and control functions such as described, for example within U.S. Pat. No. 4,801,907. The operating mechanism as described within the aforementioned U.S. patent application Ser. No. 08/203,062 includes a closing shaft 21 which provides the forces required to charge the powerful operating mechanism springs 43 shown in FIG. 3. Referring back to FIG. 1, the operating handle 15 located within the handle recess 16 allows manual operation of the circuit breaker operating mechanism as well as providing manual means for charging the operating mechanism springs through operation of the handle drive assembly 23. The handle 15 is attached to the operating mechanism sideframe 41 by means of the handle pivot pin 46 and is connected with the handle drive gear 18 by a pair of handle drive links 17. The handle drive gear includes a series of handle drive teeth 19 that are driven by the handle drive links and a separate series of handle locking teeth 20 that interact with a locking pawl 22 to restrain the handle drive gear from reverse rotation during the operating spring charging process as described in the aforementioned U.S. patent application Ser. No. 08/214,522. In accordance with the teachings of this invention, a two stage operating springs latching assembly 25 interacts with the locking pawl 22 to controllably allow the pawl 22 to engage the locking teeth 20 to prevent rotation of the closing shaft 21 while the operating springs are being charged. The latching assembly includes a closing cradle 29 which rotates about the closing cradle pivot pin 30 arranged at the bottom thereof, an intermediate latch 27 at the top of the closing cradle which rotates about the intermediate latch pivot pin 28 and a primary latch 26 arranged at the top of the intermediate latch.

Figure 2A:
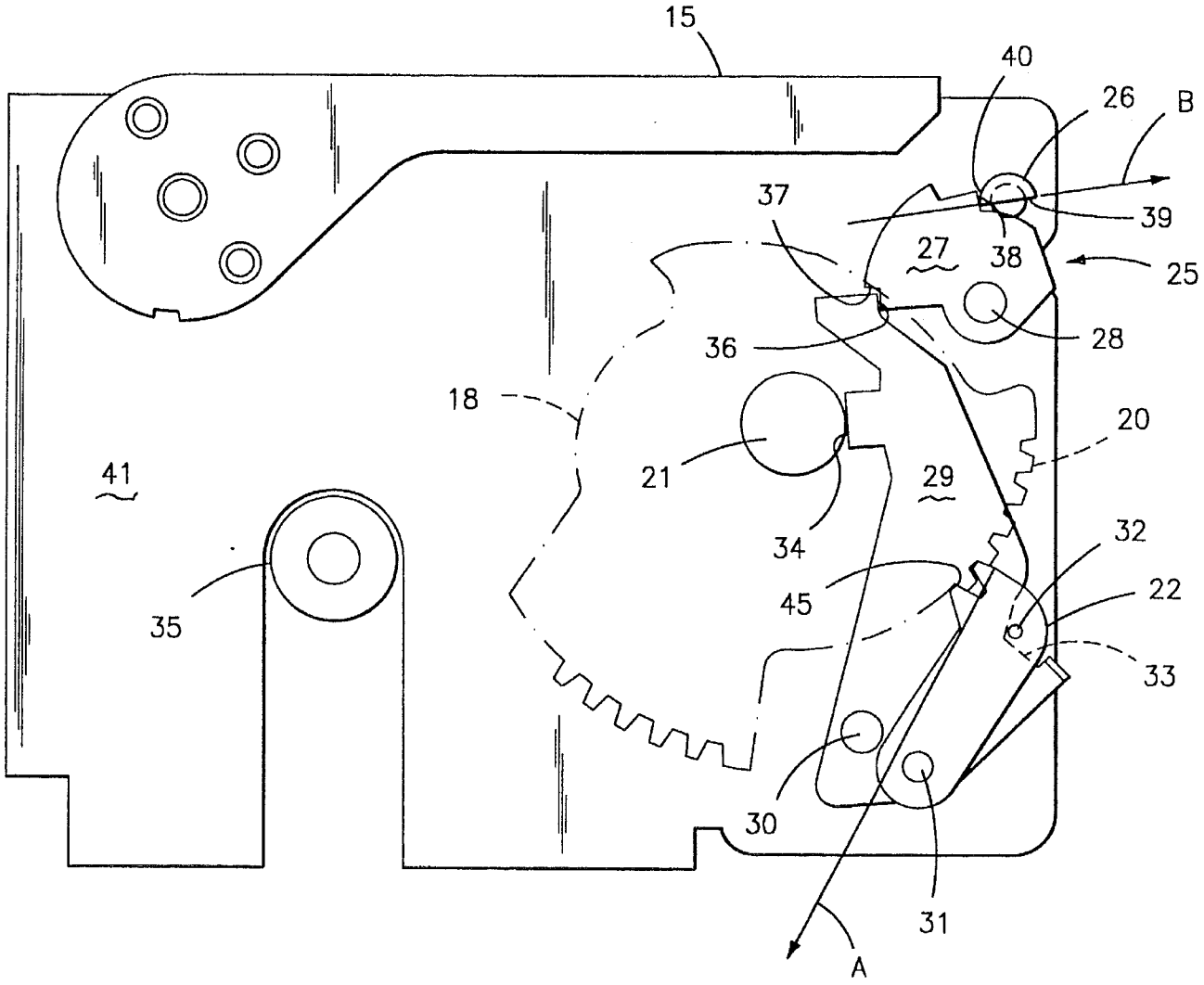
FIG. 2A is a plan side view of the operating springs latching assembly of FIG. 1 with the latches engaged.
Figure 2B:
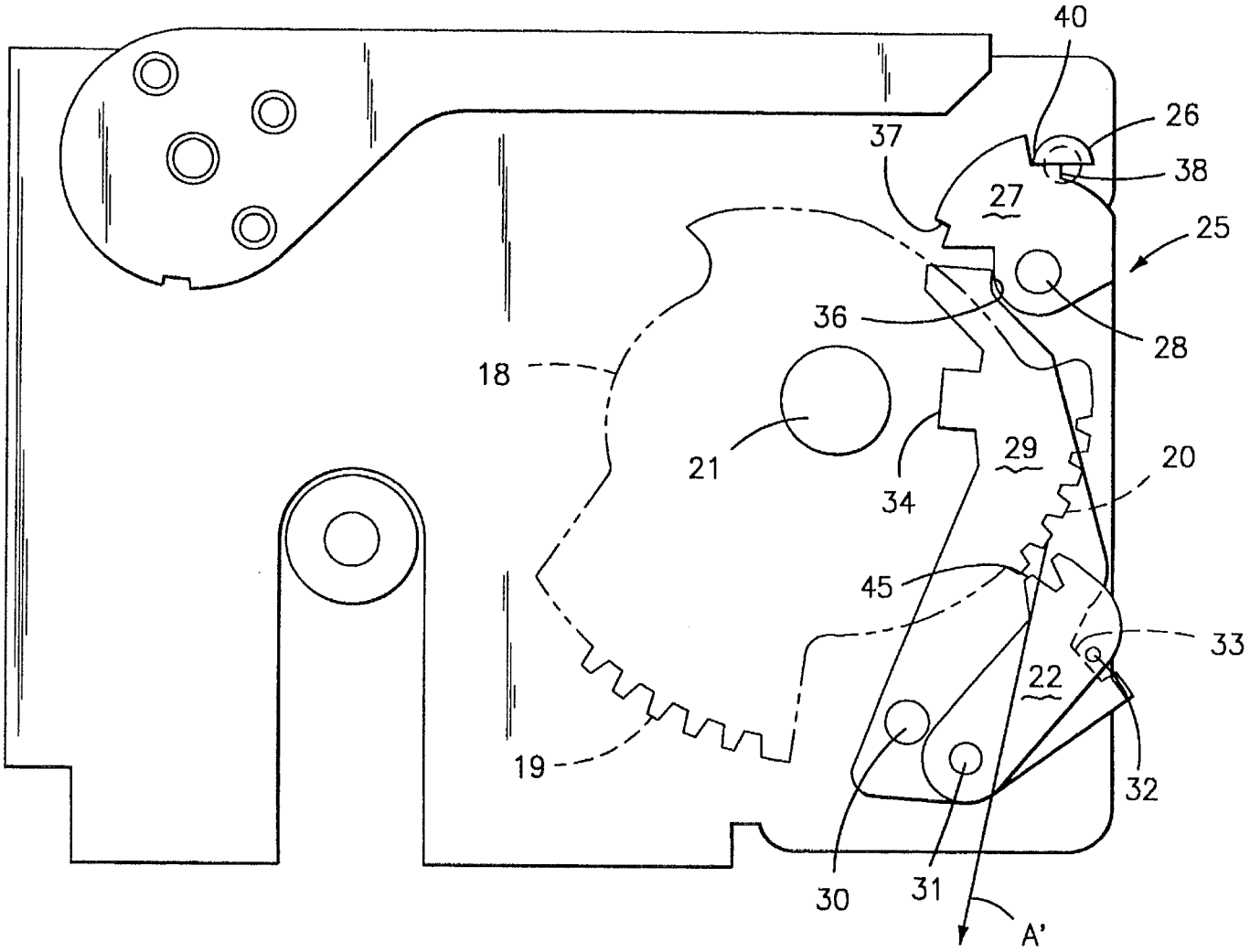
FIG. 2B is a plan side view of the handle operating springs latching assembly of FIG. 1 with the latches released.

The operation of the latching assembly 25 is best seen by referring jointly to the "latched" configuration shown in FIG. 2A and to the "unlatched" configuration shown in FIG. 2B. The latching assembly is shown relative to the drive shaft 35 that is biased by the operating mechanism opening springs that were described within the aforementioned U.S. patent application Ser. No. 08/202,140 to separate the circuit breaker contacts. The closing shaft 21 is biased by the operating mechanism closing springs 43 shown in FIG. 4. Still referring to FIG. 2A, the handle drive gear 18 is depicted in phantom to show the positional relationship between the locking teeth 20 on the drive gear and the locking pawl teeth 45 on the locking pawl 22. The closing cradle 29 is attached to the operating mechanism sideframe 41 by means of the closing cradle pivot pin 30 and is arranged with the cradle latching surface 36 in contact with the latching surface 37 on the intermediate closing latch 27 to prevent the locking pawl 22 which is attached to the closing cradle 29 by means of the locking pawl pivot pin 31 from rotating in the clockwise direction whereby the locking pawl teeth 45 would be out of engagement with the locking teeth 20 depicted in phantom on the handle drive gear 18. In this position, the closing cradle stop 34 is in abutment against the closing shaft 21 and the pawl stop pin 32 is against the forward surface of the stop pin slot 33 formed on the back surface of the closing cradle 29. The forces exerted by the closing springs are now directed in the direction of the force vector A forward of the locking pawl pivot pin 31 to hold the locking pawl tightly against handle drive gear. The intermediate closing latch 27 is prevented from rotating clockwise about the intermediate closing latch pivot 28 by the interference provided between the latching surface 38 on the intermediate closing latch 27 and the latching surface 40 on the primary closing latch 26. The forces exerted by the closing springs are now directed in the direction of the force vector B through the center of the primary closing latch pivot 39 to insure that the intermediate closing latch 27 is prevented from rotating in the clockwise direction when the operating handle is lifted to charge the closing springs in the manner described in the aforementioned U.S. patent application Ser. No. 08/214,522.

To release the locking pawl 22 from the handle drive gear 18, whereby the locking pawl teeth 45 are out of engagement with the locking teeth 20 on the handle drive gear, the primary closing latch 26 is rotated clockwise moving the latching surface 40 on the primary closing latch away from the latching surface 38 on the intermediate closing latch and allowing the forces exerted by the closing springs to thereby rotate the latching surface 37 on the intermediate closing latch 27 away from the latching surface 36 on the closing cradle 29 allowing the closing cradle to rotate clockwise about the closing cradle pivot 30 away from the closing shaft 21. The locking pawl 22 rotates clockwise about the locking pawl pivot 31 moving the teeth 45 on the locking pawl out of engagement with the locking teeth 20 on the handle drive gear 18 driving the pawl stop pin 32 against the rear surface of the stop pin slot 33. The closing springs are fully charged and operational to close the circuit breaker contacts independent from the handle drive assembly.

Figure 3:
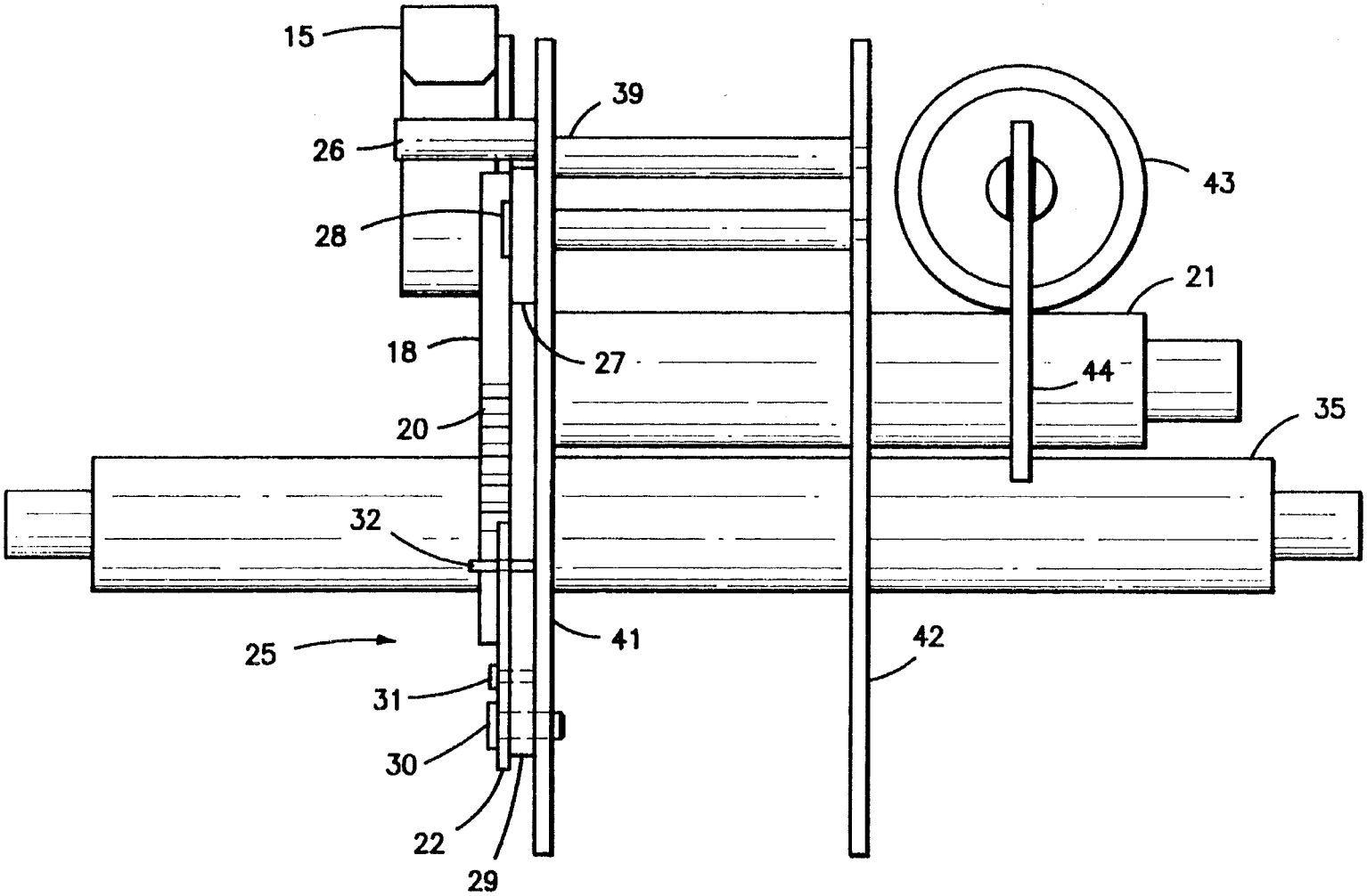
FIG. 3 is an end view of the operating springs latching assembly of FIG. 1.

The closing latch assembly 25 is depicted in FIG. 3 to show the compact arrangement of the components on the operating mechanism sideframe 41. The primary latch pivot pin 39 extends between the sideframes 41, 42 to position the primary closing latch 26 subjacent the operating handle 15 and on top of the handle drive gear 18 which is positioned on the closing shaft 21. The intermediate closing latch pivot pin 28 extends between the operating mechanism sideframes and positions the intermediate closing latch 27 in line with the closing cradle 29 that is attached to the operating mechanism sideframe 41 and to the locking pawl 22 by means of the closing cradle pivot 30. The locking pawl pivot 31 is separately attached to the closing cradle for independent rotation thereof and is positioned relative to the locking teeth on the handle drive gear 18 by means of the locking pawl stop pin 32 in the manner described earlier. The closing springs 43 connect with the closing shaft 21 by means of the closing spring crank 44 to thereby receive the spring charging forces generated by the operating handle 15 through the handle drive gear 18 in accordance with the teachings of the invention.

We claim:

1. An industrial-rated circuit breaker for high level overcurrent protection comprising:

an insulative base 11;

an insulative cover 13 above said base, said cover enclosing a closing shaft 21 and a drive shaft 35 extending between a pair of operating mechanism sideframes 41,42;

a closing spring 43 connecting with said closing shaft, said closing spring receiving forces for moving said spring into a charged condition;

a handle 15 interacting with said closing shaft through a handle drive gear 18 allowing an operator to provide said forces; and a closing latch arrangement operatively connecting a locking pawl with said handle drive gear when said operating spring is receiving said forces and releasing said locking pawl from said handle drive gear when said spring becomes fully charged.

2. The circuit breaker of claim 1 wherein said closing latch arrangement includes a closing cradle 29 pivotally attached at one end to one of said sideframes.

3. The circuit breaker of claim 2 including a primary closing latch 26 and an intermediate closing latch 27 interacting with said closing cradle for engaging and disengaging said locking pawl from said handle drive gear.

4. The circuit breaker of claim 3 including a cradle latching surface 36 on said closing cradle and a first intermediate latching surface 37 on said intermediate closing latch in contact with each other to hold said locking pawl in engagement with said handle drive gear.

5. The circuit breaker of claim 3 including a second intermediate latching surface 38 on said intermediate closing latch and a primary latching surface 40 on a primary closing latch 26 to prevent said intermediate closing latch from rotating away from said closing cradle.

6. The circuit breaker of claim 2 including a locking pawl pivot pin 31 at one end of said locking pawl attaching said locking pawl to said closing cradle.

7. The circuit breaker of claim 6 including a stop pin 32 at an opposite end of said locking pawl, said stop pin being captured within a slot formed within said closing cradle, said stop pin being in contact with one edge of said slot when said locking pawl is engaged with said handle drive gear, said stop pin being in contact with an opposite edge of said slot when said locking pawl is disengaged from said handle drive gear.

8. The circuit breaker of claim 6 including a cradle stop 34 on a forward edge of said closing cradle, said cradle stop being in contact with said closing shaft when said locking pawl is engaged with said handle drive gear and said cradle stop being out of contact with said closing shaft when said cradle latching surface is in contact with said intermediate latching surface.

9. An industrial-rated circuit breaker for high level overcurrent protection comprising:

an insulative base 11;

an insulative cover 13 above said base, said cover enclosing a closing shaft 21 and a drive shaft 35 extending between a pair of operating mechanism sideframes 41,42;

a closing spring 43 connecting with said closing shaft, said closing spring receiving forces for moving said spring into a charged condition;

a handle 15 connecting with said closing shaft through a handle drive gear 18 and a locking pawl 22 allowing an operator to provide said forces;

a closing cradle 29 pivotally attached at one end to one of said sideframes and a primary closing latch 26 pivotally attached to said one sideframe; and an intermediate closing latch 27 pivotally attached to said one sideframe intermediate said closing cradle and said primary closing latch to restrain said closing cradle from rotation while said closing spring is being charged.

10. The industrial-rated circuit breaker of claim 9 including a cradle latching surface 36 on said closing cradle and a first intermediate latching surface 37 on said intermediate closing latch in contact with each other to hold said locking pawl in engagement with said handle drive gear.

11. The industrial-rated circuit breaker of claim 10 including a second intermediate latching surface 38 on said intermediate closing latch and a primary latching surface 40 on said primary latch 26 to prevent said intermediate closing latch from rotating away from said closing cradle.

12. The industrial-rated circuit breaker of claim 11 including a locking pawl pivot pin 31 at one end of said locking pawl attaching said locking pawl to said closing cradle.

13. The industrial-rated circuit breaker of claim 12 including a stop pin 32 at an opposite end of said locking pawl, said stop pin being captured within a slot formed within said closing cradle, said stop pin being in contact with one edge of said slot when said locking pawl is engaged with said handle drive gear, said stop pin being in contact with an opposite edge of said slot when said locking pawl is disengaged from said handle drive gear.

14. The industrial-rated circuit breaker of claim 12 including a cradle stop 34 on a forward edge of said closing cradle, said cradle stop being in contact with said closing shaft when said cradle latching surface is engaged with said intermediate latching surface.

* * * * *

UNITED STATES PATENT AND TRADEMARK OFFICE

CERTIFICATE OF CORRECTION

PATENT NO. : 5,488,211

DATED : January 30, 1996

INVENTOR(S) : Roger N. Castonguay, et al

It is certified that error appears in the above-indentified patent and that said Letters Patent is hereby corrected as shown below:

On the title page, after item [76] Inventors: insert the following:

--[73] Assignee: General Electric Compay, New York, N.Y.--.

Signed and Sealed this

Sixteenth Day of September, 1997

*Attest:*

Bruce Lehman

BRUCE LEHMAN

*Attesting Officer*

*Commissioner of Patents and Trademarks*